United States Patent [19]

Puskas et al.

[11] 4,419,662

[45] Dec. 6, 1983

[54] CHARACTER GENERATOR WITH LATCHED OUTPUTS

[75] Inventors: Jeffery A. Puskas, Prospect Heights; Peter C. Skerlos, Arlington Heights; Thomas J. Zato, Palatine, all of Ill.

[73] Assignee: Zenith Radio Corporation, Glenview, Ill.

[21] Appl. No.: 260,639

[22] Filed: May 4, 1981

[51] Int. Cl.[3] ..... G09G 1/16

[52] U.S. Cl. ..... 340/750; 340/721; 340/731; 358/165; 358/183

[58] Field of Search ..... 340/750, 748, 721, 731; 358/165, 183

[56] References Cited

U.S. PATENT DOCUMENTS

| | | | |
|---|---|---|---|
| 3,713,135 | 1/1973 | Lazecki . | |
| 3,732,365 | 5/1973 | Rando et al. | 358/165 |
| 4,026,555 | 5/1977 | Kirschner et al. . | |
| 4,158,837 | 6/1979 | Zahorsky | 340/750 |
| 4,213,124 | 7/1980 | Barda et al. | 340/750 |
| 4,215,343 | 7/1980 | Eijiri et al. . | |
| 4,243,987 | 1/1981 | Bobick . | |
| 4,303,986 | 12/1981 | Lans | 340/750 |
| 4,337,480 | 6/1982 | Bourassin et al. | 358/183 |

*Primary Examiner*—Marshall M. Curtis

[57] ABSTRACT

A character generator driven by a microcomputer and providing latched outputs is disclosed. Flexibility in character size and character array positioning on the video display is provided for in this 60-character display generator integrated circuit. A plurality of latched outputs permits the character generator to perform additional functions while reducing the number of dedicated microcomputer outputs required to perform these and similar functions. The character generator is particularly adapted for use in a television receiver where characters are displayed on the face of the cathode ray tube.

6 Claims, 4 Drawing Figures

CHARACTER GENERATOR WITH LATCHED OUTPUTS

CROSS-REFERENCE TO RELATED APPLICATION

This application is related to but in no way dependent upon the following application which is assigned to the assignee of the present application: Ser. No. 243,010, filed Mar. 12, 1981, entitled "Microcomputer-Controlled Television/Telephone System and Method Therefore," in the names of Peter C. Skerlos, Paul A. Snopko, Frank C. Templin and Thomas J. Zato, which has issued as U.S. Pat. No. 4,356,509 dated Oct. 26, 1982.

BACKGROUND OF THE INVENTION

This invention relates generally to the presentation of characters on a video display, and particularly relates to an improved multi-function character generator particularly adapted for use in a television receiver.

A digital data display system typically receives digitally encoded information from a computer and provides a presentation of that information in the form of characters on the screen of a video display such as a cathode ray tube (CRT). The display of selected characters under computer control is generally accomplished by simultaneously varying the horizontal and vertical beam deflection signals to the CRT in synchronization with electron beam intensity control according to displayed character configuration. The deflection signals are usually current or voltages provided to the CRT deflection system while electron beam intensity is controlled by CRT inter-electrode potentials. The characters are formed as a sequence of discrete, intensified units of area in the form of a dot matrix in positions defined by the vertical and horizontal sweep voltages. The rapid vertical and horizontal sweeping of the CRT faceplate by the electron beam, the intensity of which is selectively modulated, generates the individual dots which comprise individual character configurations.

The computerized video display system generally includes a central processing unit for performing data processing tasks, such as the input and output of digital data signals, storing digital data in a memory, and selectively reading out this stored data and providing it to the CRT in generating the desired character array on the face of the CRT. Information may be provided to the computer by a variety of means, the most popular currently being a keyboard.

Interfacing the computer with the video display generally is a signal processing circuit termed the character generator. A typical character generator includes a read only memory (ROM) in which are stored digital codes for the dot matrix display of individual characters. Also included in the character generator is a random access memory (RAM) which includes various storage locations corresponding to video display faceplate positions in which are stored coded signals representing individual characters received from the computer. A controller in the character generator is responsible for selectively accessing the stored contents in the ROM in accordance with the coded signals stored in RAM and for providing these selectively read-out dot matrix arrangements to the video display. Essential to the operation of the character generator is a source of clocking signals for the proper timing of input and output signals in achieving synchronization with electron beam sweep and for establishing proper timing between the RAM and ROM and various other character generator components in carrying out essential signal processing operations.

Most recently, word processor systems utilized for document creation and text editing have become another new application for computer driven video displays. One such computer driven video display system is disclosed in U.S. Pat. No. 4,243,987 to Bobick wherein is described a video display processor which receives coded character data and digitally encoded text manipulative data from an input device such as a keyboard and generates horizontal sync, vertical sync, and video data in the form of a display scan line dot pattern. The display processor is comprised of a display refresh memory for retaining text character codes and text manipulative codes, a character generator that receives text and text manipulative data from the display refresh memory and converts it to a video signal, video output circuitry interfacing the display processor with a video display, and microprogram timing and control logic to provide the required timing and control signals for proper operation sequencing. This device, similar to other word processing systems, is designed to display a full page of type-written copy and thus lacks flexibility in limited size text positioning on the video display face and is incapable of performing functions in addition to those related to character display.

Another approach to digital symbol generation is disclosed in U.S. Pat. No. 3,713,135 to Lazecki which is primarily concerned with the positioning of displayed characters on the face of a CRT. In this system the vertical location of a character segment upon the display is completely described by a pair of dimension numbers, where one dimension number equals the raster line identification number of the topmost line of the segment and the other number equals the raster line identification number of the line below that segment. By performing subtraction operations involving segment lines located between these two numbers and segment lines located outside the vertical space defined by these two numbers, either a positive or negative number will result, from which the raster lines on the CRT where it is desired to display a given character may be determined. This approach allegedly simplifies and makes more reliable video display raster control. Another approach to more flexible character positioning on a video display is disclosed in U.S. Pat. No. 4,215,343 to Ejiri et al. which makes use of recirculating shift registers including respectively display pattern information and display position information in a computer driven CRT. The location within a shift register of a particular pattern code corresponds to the horizontal position where that pattern is to be displayed on the face of the CRT. The display position codes are indicative of the vertical positions of the corresponding patterns represented by the pattern codes. This digital pattern display system includes two ROMs one of which is primarily involved with character vertical positioning while the other ROM functions primarily in generating the proper character pattern to be displayed. The last two discussed patents function solely and exclusively as vertical positioning controllers for the proper location of characters on the face of the CRT.

A video display control system for use with a conventional television receiver is disclosed in U.S. Pat. No. 4,026,555 to Kirschner et al. This apparatus incorporates a random access memory (RAM) having a plurality of data storage positions for maintaining a digital representation of the data to be displayed on the television screen. Display data is written into the RAM under the control of a programmed microprocessor which modifies the display data stored in memory in accordance with manual keyboard entries. The display data is read from the memory in synchronism with the scanning of the television screen. In addition, the microprocessor is adapted to perform a variety of standard calculator functions to permit the television screen to display performed calculator operations. Thus, this system is designed to function solely as a video display controller and is not intended to perform additional functions in the television receiver environment.

The present invention, while fully capable of controlling a video display in the presentation of a great variety of character arrays, is also capable of providing additional control signals to the television receiver, or to any system in which it is used, for performing additional functions therein.

OBJECTS OF THE INVENTION

Accordingly, it is an object of the present invention to provide an improved character generator for use with a video display.

It is another object of the present invention to provide a system capable of not only driving a video display in the presentation of alphanumeric characters but also of performing additional functions.

Still another object of the present invention is to provide a microcomputer-controlled character generator for use in a television receiver which offers enhanced flexibility in terms of character size and character array position on the television receiver's screen.

A further object of the present invention is to provide an improved means for converting the digital output signals of a microcomputer into a series of signals capable of driving a video display in presenting alphanumeric character information.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings in which:

DESCRIPTION OF THE PREFERRED EMBODIMENTS

Figure 1:
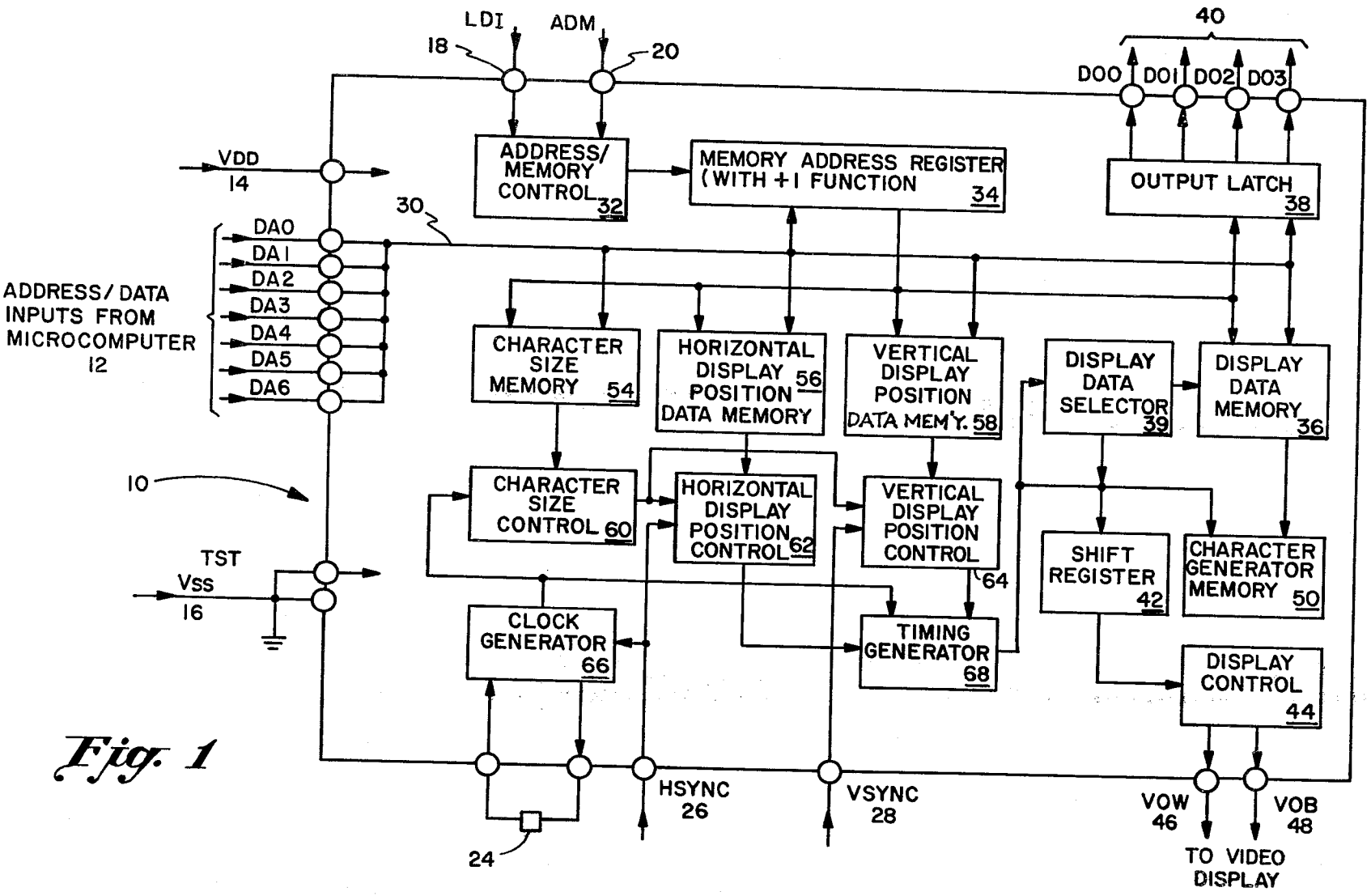
FIG. 1 is a generalized block diagram of a character generator with latched outputs in accordance with the present invention.

Referring to FIG. 1, there is shown a generalized block diagram of a character generator with latched outputs 10 in accordance with the present invention. A plurality of address/data inputs 12 from a microcomputer (not shown) are provided to character generator 10. These input signals and the pins to which they are provided are label DA0 through DA6 in FIG. 1. Thus, there are seven bits of information provided to character generator 10 by a microcomputer in the preferred embodiment of the present invention, although the present invention is not limited to this specific number of parallel inputs. The parallel inputs DA0 through DA6 are then serially provided to data bus 30 where they are coupled to output latch 38 and display data memory 36 under the control of address/memory control 32 and memory address register 34. Display data memory 36 under the control of display data selector 39 and in conjunction with character generator memory 50 and shift register 42 provides the appropriate character signals to display control 44 in providing appropriate character information to a video display (not shown), such as a cathode ray tube. Output latch 38 under the control of the appropriate information bits provided to address/data bus 30 provides a plurality of latched outputs 40 to output pins labeled DO0 through DO3. Again, four latched outputs 40 are provided in the preferred embodiment of the present invention, although the present invention is not limited to this specific number of output control signals. Details regarding the manner in which these latched outputs are utilized in a preferred embodiment of the present invention are presented in co-pending patent application Ser. No. 243,010, filed Mar. 12, 1981, entitled "Microcomputer-Controlled Television/Telephone System and Method Therefore," in the names of Peter C. Skerlos, Paul A. Snopko, Frank C. Templin and Thomas J. Zato, which has issued as U.S. Pat. No. 4,356,509 dated Oct. 26, 1982 and which is hereby incorporated by reference. As described therein, the four latched outputs of character generator 10 control telephone switching circuitry, audio muting circuitry, microphone sensitivity circuitry in the telephone mode of operation and video blanking circuitry all in the television receiver.

Seven address/data lines DA0 through DA6 are provided to character generator 10 from a source of digital input signals such as a microcomputer. Each of the input lines DA0, DA1, DA2, DA3, DA4, DA5, and DA6 represent an individual address or data bit and are provided in a serial fashion to data bus 30 for distribution to various elements of character generator 10. This address and data information is provided by means of address/data bus 30 to display data memory 36 which is a random access memory (RAM) element having 66 addressable memory locations for the storage of character data. This address and data information is clocked into character generator 10 by means of an initialization pulse provided by the microcomputer to the LDI pin 18. The address information is provided by means of data bus 30 to memory address register 34 which, under the control of address/memory control 32, ensures that the proper character information is stored in the proper location in data display memory 36.

Figure 2:
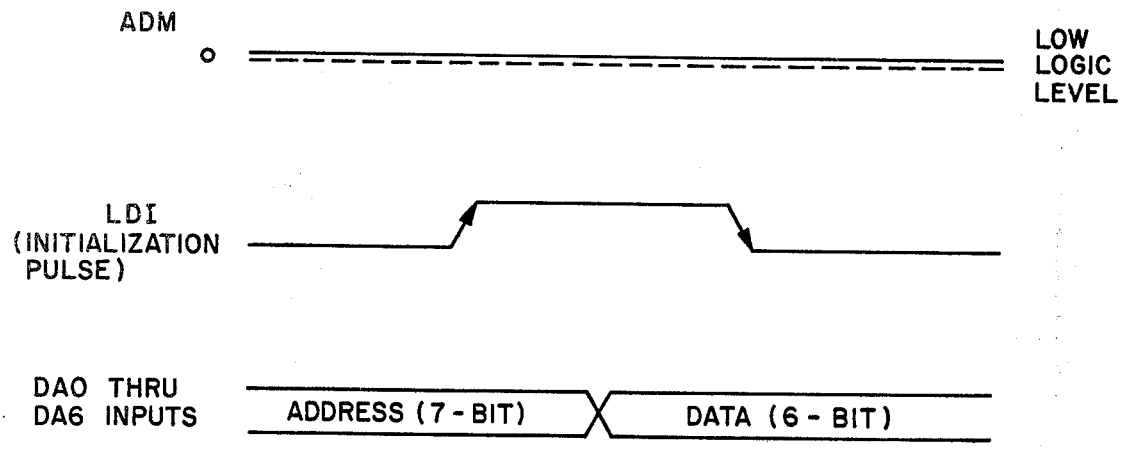
FIG. 2 is a representation of the initialization input signals provided to the character generator including address and data information.

Referring to FIG. 2, a microcomputer initialization input to LDI input pin 18 and a logic level input to ADM pin 20 and their effect on the address and data information provided to memory address register 34 is shown. The microcomputer provides either a high or a low logic level signal to the character generator's ADM input pin 20. If a low logic level signal is provided by the microcomputer, data display memory 36 addressing is accomplished entirely by the address information provided to the DA0 through DA6 pins. If a low level logic signal is provided to ADM pin 20, a positive transition of an initialization pulse provided to address memory control 32 via LDI pin 18 will result in an incrementing of the addressed location in data display memory 36 in accordance with the 7-bit address data information provided to input pins DA0 through DA6. Upon the arrival of the positive-going edge of the initialization pulse, the 7-bit data provided to input pins DA0 through DA6 is latched into memory address register 34 while the 6-bit data provided to input pins DA0 through DA5 is written into the data memory of display data memory 36 as specified by the contents of memory address register 34 on the negative edge of the initialization pulse provided to address memory control 32. It is in this manner that digital data representing characters to be displayed at specific locations on the video display are temporarily stored in the random access memory of display data memory 36.

Figure 3:
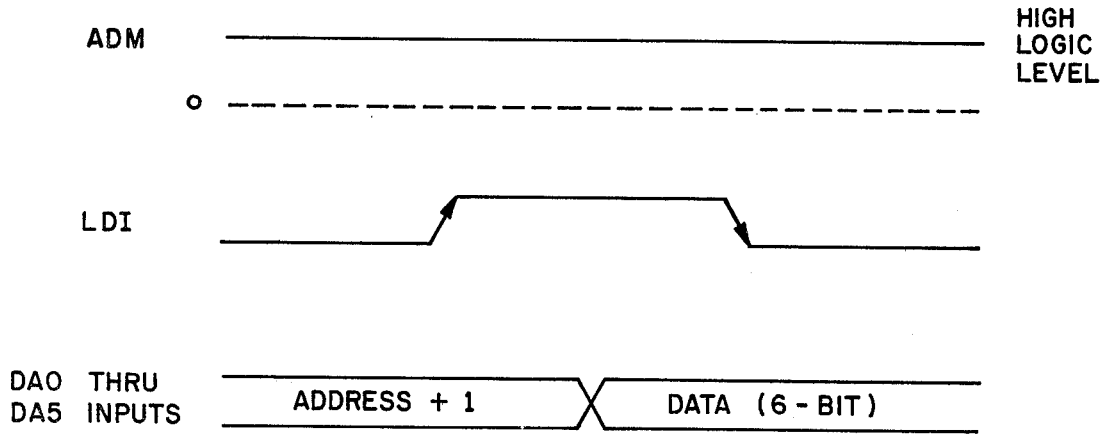
FIG. 3 represents the initialization input signals provided to the character generator in the memory address automatic incrementing mode of operation.

Referring to FIG. 3, when ADM pin 20 is set to a high logic level in accordance with an input signal provided thereto by the microcomputer, the contents of memory address register 34 are incremented by 1 upon the arrival of the positive-going edge of the initialization pulse provided to memory address control 32. When the negative-going, trailing edge of the initialization pulse is provided by address/memory control 32 to memory address register 34, the 6-bit character data provided to input pins DA0 through DA5 is written into the memory of display data memory 36 as specified by the contents of memory address register 34 which has just been incremented by 1. By thus controlling the logic level of the signal provided to the ADM input pin 20, the matrix memory locations in display data memory 36 may be accessed either automatically in an incrementing manner or by selectively accessing individual memory locations.

Figure 4:
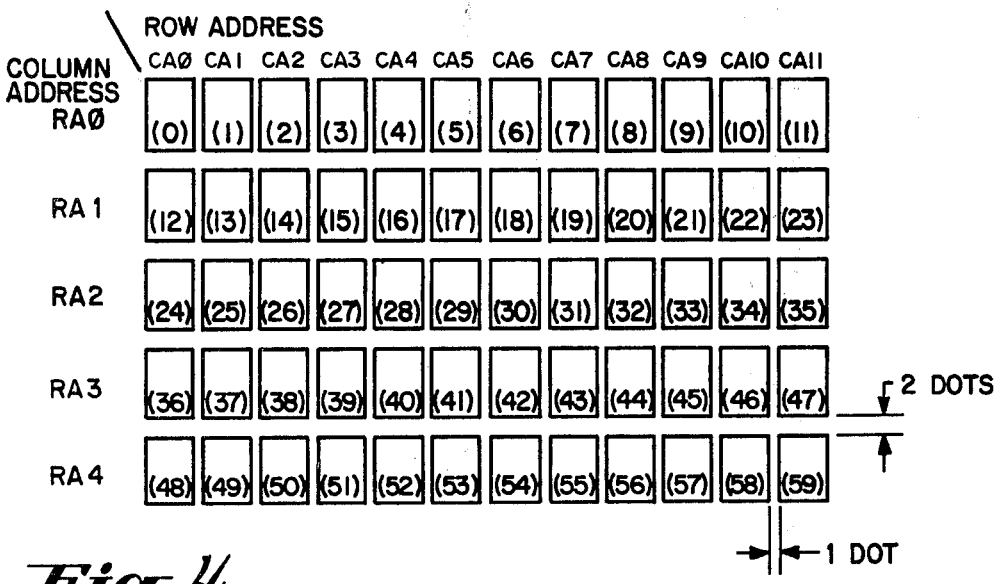
FIG. 4 illustrates the 5 row×12 column matrix array presented on the video display as it relates to RAM storage locations.

The matrix arrangement of display data memory 36 is shown in Table I. Table I presents the memory map of display data memory 36 in terms of the DA6 through DA0 bit inputs, where DA6 represents the most significant bit (MSB) and DA0 represents the least significant bit (LSB). From FIG. 4 and Table I it can be seen that the memory matrix of display data memory 36 consists of a 5 row×12 column matrix for storing data representing 60 characters, although not all memory locations are utilized in the present invention. Memory locations numbered 60 through 66, as shown in Table I, are used for character positioning, size control and display blanking. Memory location 60 stores horizontal position data while memory position 61 stores vertical position data.

TABLE I

| RAM MEMORY MAP | | |
|---|---|---|
| (#) | DA6(MSB)-DA0(LSB) | MEMORY WORD |
| 0 | 0000000 | Row-1 Col-1 |
| 1 | 0000001 | Row-1 Col-2 |
| 2 | 0000010 | Row-1 Col-3 |
| 3 | 0000011 | Row-1 Col-4 |
| 4 | 0000100 | Row-1 Col-5 |
| 5 | 0000101 | Row-1 Col-6 |
| 6 | 0000110 | Row-1 Col-7 |
| 7 | 0000111 | Row-1 Col-8 |
| 8 | 0001000 | Row-1 Col-9 |
| 9 | 0001001 | Row-1 Col-10 |
| 10 | 0001010 | Row-1 Col-11 |
| 11 | 0001011 | Row-1 Col-12 |
| 12 | 0001100 | Row-2 Col-1 |
| 13 | 0001101 | Row-2 Col-2 |
| 14 | 0001110 | Row-2 Col-3 |
| 15 | 0001111 | Row-2 Col-4 |

TABLE I-continued

| RAM MEMORY MAP | | |
|---|---|---|
| (#) | DA6(MSB)-DA0(LSB) | MEMORY WORD |
| 16 | 0010000 | Row-2 Col-5 |
| 17 | 0010001 | Row-2 Col-6 |
| 18 | 0010010 | Row-2 Col-7 |
| 19 | 0010011 | Row-2 Col-8 |
| 20 | 0010100 | Row-2 Col-9 |
| 21 | 0010101 | Row-2 Col-10 |
| 22 | 0010110 | Row-2 Col-11 |
| 23 | 0010111 | Row-2 Col-12 |
| 24 | 0011000 | Row-3 Col-1 |
| 25 | 0011001 | Row-3 Col-2 |
| 26 | 0011010 | Row-3 Col-3 |
| 27 | 0011011 | Row-3 Col-4 |
| 28 | 0011100 | Row-3 Col-5 |
| 29 | 0011101 | Row-3 Col-6 |
| 30 | 0011110 | Row-3 Col-7 |
| 31 | 0011111 | Row-3 Col-8 |
| 32 | 0100000 | Row-3 Col-9 |
| 33 | 0100001 | Row-3 Col-10 |
| 34 | 0100010 | Row-3 Col-11 |
| 35 | 0100011 | Row-3 Col-12 |
| 36 | 0100100 | Row-4 Col-1 |
| 37 | 0100101 | Row-4 Col-2 |
| 38 | 0100110 | Row-4 Col-3 |
| 39 | 0100111 | Row-4 Col-4 |
| 40 | 0101000 | Row-4 Col-5 |
| 41 | 0101001 | Row-4 Col-6 |
| 42 | 0101010 | Row-4 Col-7 |
| 43 | 0101011 | Row-4 Col-8 |
| 44 | 0101100 | Row-4 Col-9 |
| 45 | 0101101 | Row-4 Col-10 |
| 46 | 0101110 | Row-4 Col-11 |
| 47 | 0101111 | Row-4 Col-12 |
| 48 | 0110000 | Row-5 Col-1 |
| 49 | 0110001 | Row-5 Col-2 |
| 50 | 0110010 | Row-5 Col-3 |
| 51 | 0110011 | Row-5 Col-4 |
| 52 | 0110100 | Row-5 Col-5 |
| 53 | 0110101 | Row-5 Col-6 |
| 54 | 0110110 | Row-5 Col-7 |
| 55 | 0110111 | Row-5 Col-8 |
| 56 | 0111000 | Row-5 Col-9 |
| 57 | 0111001 | Row-5 Col-10 |
| 58 | 0111010 | Row-5 Col-11 |
| 59 | 0111011 | Row-5 Col-12 |
| 60 | 0111100 | HOR POS DATA |
| 61 | 0111101 | VRT POS DATA |
| 62 | 0111110 | BLANK & SIZE |
| 63 | 0111111 | OUTPUT DATA |
| 64 | 1000000 | ROW BLANKING |
| 65 | 1000001 | COL BLANKING |
| 66 | 1000010 | COL BLANKING |

Memory position 62 is used for character blanking and size control while position 63 is used for controlling the latched outputs 40 provided to output pins DO0 through DO3. RAM location number 64 is used for storing row blanking information for the 5 rows in the character display while memory locations 65 and 66 contain column blanking information for the 12 columns of the character display. Micro-computer inputs provided to terminals DA0 through DA6 provide address information in accordance with Tables I and II to memory address register 34 on the positive (low to high) transition of the initialization pulse provided to character generator 10 while data is provided via the same input terminals in accordance with Tables I and II on the negative (high to low) transition of the initiation pulse provided to character generator 10 at the LDI input terminal 18. When BLKB=1, the displayed background output is disabled. When BLK=1, the entire display is suppressed.

Display character and dot size is controlled by the SZ bits at location number 62 in display data memory 36.

Table III illustrates the various combinations of the binary states of SZ1 and SZ0. From Table III it can be seen that the various combinations of the states of the SZ1 and SZ0 bits in display data memory 36 are capable of providing various vertical and horizontal character sizes. The CHAR-VERT column represents the number of horizontal sync pulses over which the height of a given character extends. From Table III it can be seen that when the SZ1 and SZ0 bits are both 0, a character 14 horizontal sweeps in vertical height is produced. Similarly, a 1 stored in each of the SZ1 and SZ0 positions in display data memory 36 will result in a vertical size of an individual character dot equivalent to 8 horizontal sweeps. The horizontal dimension of an individual character is determined by the duration of electron beam irradiation on the face of the video display. Thus, from Table III it can be seen that the horizontal dimension of an individual character may be varied from 2 microseconds to 8 microseconds in terms of the electron beam horizontal scan. Similarly, individual character dot horizontal size may be varied from 0.4 microseconds to 1.6 microseconds by the selective irradiation for various times in the horizontal direction of particular locations on the screen of the video display.

TABLE III

| SZ1 | SZ0 | CHAR-VERT | CHAR-HORIZ | DOT-VERT | DOT-HORIZ |
|---|---|---|---|---|---|
| 0 | 0 | 14H | 2uS | 2H | 0.4uSec. |
| 0 | 1 | 28H | 4uS | 4H | 0.8uSec. |
| 1 | 0 | 42H | 6uS | 6H | 1.2uSec. |
| 1 | 1 | 56H | 8uS | 8H | 1.6uSec. |

TABLE IV

| CHARACTER | DA6-DA0 | CHARACTER | DA6-DA0 | CHARACTER | DA6-DA0 |
|---|---|---|---|---|---|
| A | 0000000 | N | 0010000 | 0 | 0100000 |
| B | 0000001 | O | 0010001 | 1 | 0100001 |
| C | 0000010 | P | 0010010 | 2 | 0100010 |
| D | 0000011 | Q | 0010011 | 3 | 0100011 |
| E | 0000100 | R | 0010100 | 4 | 0100100 |
| F | 0000101 | S | 0010101 | 5 | 0100101 |
| G | 0000110 | T | 0010110 | 6 | 0100110 |
| H | 0000111 | U | 0010111 | 7 | 0100111 |
| I | 0001000 | V | 0011000 | 8 | 0101000 |
| J | 0001001 | W | 0011001 | 9 | 0101001 |
| K | 0001010 | X | 0011010 | : (COLON) | 0101010 |
| L | 0001011 | Y | 0011011 | . (PERIOD) | 0101011 |
| M | 0001100 | Z | 0011100 | - (DASH) | 0101100 |
| . (DOT) | 0001101 | ? (QUERY) | 0011101 | / (SLASH) | 0101101 |
| BACKGROUND ONLY-SPACE | 0001110 | SPACE | 0011110 | SPACE | 0101101 |
| DISPLAY SUPPRESS | 0001111 | SUPPRESS | 0011111 | SUPPRESS | 0101111 |

Table IV presents the display font data code stored in character generator memory 50.

TABLE II

| ADDRESS | DA6 | DA5 | DA4 | DA3 | DA2 | DA1 | DA0 |
|---|---|---|---|---|---|---|---|
| #60-HORZ POS DATA | 0 | HP5 | HP4 | HP3 | HP2 | HP1 | HP0 |
| #61-VERT POS DATA | 0 | VP5 | VP4 | VP3 | VP2 | VP1 | VP0 |
| #62-BLANK & SIZE | 0 | BLKB | BLK | 0 | 0 | SZ1 | SZ0 |
| #63-OUT-PUT DATA | 0 | 0 | 0 | DO3 | DO2 | DO1 | DO0 |
| #64-ROW BLANKING | 0 | 0 | RB5 | RB4 | RB3 | RB2 | RB1 |
| #65-COL BLANKING | 0 | CB6 | CB5 | CB4 | CB3 | CB2 | CB1 |
| #66-COL BLANKING | 0 | CB12 | CB11 | CB10 | CB9 | CB8 | CB7 |

| | | |
|---|---|---|
| HP0-5 | Horizontal display position control | 6 BITS |
| VP0-5 | Vertical display position control | 6 BITS |
| SZ0-1 | Character size control | 2 BITS |
| BLK | Display suppress control | 1 BIT |
| BLKB | Background suppress control | 1 BIT |
| DO0-3 | General purpose outputs | 4 BITS |
| RB0-4 | Row blanking | 5 BITS |
| CB0-11 | Column blanking | 12 BITS |

Character generator memory 50 has the capacity for storing the dot matrix configuration for 60 characters, but only 48 memory locations are utilized in the preferred embodiment of the present invention. Thus, character generator memory 50 provides the desired dot matrix configuration for the formation of an individual character while display data memory 36 permits a given character to be displayed at a desired location on the face of the video display.

The character array is generated by the electron beam sweeping from left to right and from top to bottom on the faceplate of the CRT. Each character dot configuration is comprised of a 5×7 dot matrix with one dot separating each matrix in a horizontal direction and two dots being positioned vertically between adjacent dot matrices. The entire display field is surrounded by a 1 dot thick edge. As previously stated, display position on the CRT's faceplate is controlled by address/data inputs 12 provided to the DA0 through DA6 input pins of character generator 10. More specifically, display position is determined by the selective accessing of memory positions 60 and 61 in display data memory 36.

As previously discussed, information from data bus 30 is provided to display data memory 36 for purposes of generating the required dot matrix for the character to be displayed. Similarly, data bus 30 also provides information to character size memory 54, horizontal display position data memory 56 and vertical display position data memory 58. These three memories, similar to display data memory 36, are also random access memories and include stored data in addressable locations for controlling character size, horizontal display position, and vertical display position, respectively. When accessed by the proper data code from data bus 30, each of these RAMs provides the appropriate control input to character size control 60, horizontal display position control 62, and vertical display position control 64, respectively. Thus, memory address register 34, which is coupled to character size memory 54, horizontal display position data memory 56 and vertical display position data memory 58, ensures that character size data, horizontal position data and vertical position data are routed from data bus 30 to these respective random access memories. Character size control 60, horizontal display position control 62 and vertical display position control 64 are programmable counters which are programmed by the outputs of the various display memories to which they are coupled. Character size control 60, horizontal display control 62 and vertical display position control 64 are thus programmed by the data contents of character size memory 54, horizontal display position memory 56 and vertical display position data memory 58, respectively, and control the timing of output signals therefrom. The combination of horizontal display position memory 56 and horizontal display position control 62 thus allows for the counting of input clock pulses in providing the proper display horizontal positioning. These clock pulses will be discussed presently. Similarly, the combination of vertical display position data memory 58 and vertical display position control 64 allows for the counting of horizontal sweep pulses following a vertical retrace pulse to permit proper vertical positioning of the character array. Character size memory 54 in combination with character size control 60 permits the number of horizontal scans to be counted in providing proper character vertical size and provides a timing function for counting electron beam horizontal sweep duration to ensure proper character width. From FIG. 1 it can be seen that a horizontal sync pulse 26 is provided to horizontal display position control 62 in order to provide a reference from which the timing interval may be measured for horizontal positioning of the character array. Similarly, a vertical synchronization pulse 28 is provided to vertical display position control 64 in order to provide a reference from which to count in vertically positioning the character array. Because individual character horizontal size is determined by a counting process, clocking pulses from clock generator 66 are provided to character size control 60.

System timing is provided by means of timing network 24 which operates at an ungated frequency of 5 MHz and is coupled to clock generator 66 in a feedback configuration. Energized by timing network 24 which in a preferred embodiment is a conventional RC-circuit, clock generator 66 provides a timed pulse output to character size control 60 and timing generator 68. Timing generator 68, which is driven by clock generator 66, horizontal display position control 62 and vertical display position control 64 provides the proper timing for display data selector 39, shift register 42 and character generator memory 50 in generating the video character display. Timing generator 68 provides the proper sequencing to display data selector 39 in reading the contents of display data memory 36 for accessing and retrieving from character generator memory 50 the proper dot matrix for character generation. With the proper memory location in character generator memory 50 addressed, its contents are read out of memory and provided to shift register 42 in accordance with the timing sequence of timing generator 68. The reading out of the contents of character generator memory 50 is coordinated with the timing of display data memory 36 by means of display data selector 39 which provides for the proper sequencing of data into shift register 42. The digital data thus selectively and sequentially provided to shift register 42 is then provided to display control 44 which allows for the separation of the white portion of a character from the black background in providing a white output signal, VOW 46, and a black output signal, VOB 48. It is in this manner that the white characters on a black background are produced on the video display. A 5.0 VDC input signal $V_{DD}$ 14 energizes character generator 10.

There has thus been provided a microcomputer-controlled character generator for driving a video display which is also capable of providing latched output signals for performing other functions. The character generator of the present invention is particularly adapted for use in a television receiver in displaying a character array on a portion of the television receiver's screen where great flexibility is desired in the positioning and size of the character array thereon and where other television receiver functions may be controlled by the latched output signals.

While particular embodiments of the invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective against the prior art.

We claim:

1. A system for converting a plurality of parallel output signals representing video information from a microcomputer into latched control signals and characters for presentation in a dot matrix form on the display face of a cathode ray tube in a television receiver, wherein ordered character display positions are scanned in successive lines on said display face with said microcomputer output signals including character code signals, memory address code signals and timing pulse signals, said system comprising:

bus means for receiving said plurality of microcomputer parallel output signals and for converting said signals into a series of coded digital signals;

first memory means coupled to said bus means for sequentially storing data representative of said control signals and said characters in a plurality of addressable memory locations, the spatial position of each of said memory locations corresponding to the positions of said characters as displayed on the face of said cathode ray tube;

address register means coupled to said bus means and responsive to said timing pulse signals for providing said memory address code signals to said first memory means when a first edge of said timing pulse signal is received by said bus means and for providing said character code signals to said first memory means for storage therein when a second edge of said timing pulse signal is received by said bus means;

second memory means adapted to store dot matrix images representing said characters in a plurality of addressable memory locations therein;

control means coupled to said second memory means and said first memory means for selecting and reading out particular ones of said dot matrix images from said second memory means according to the sequential storage of said characters in said first memory means and for providing said dot matrix images to said cathode ray tube; and latch means including a plurality of latches coupled to said bus means for receiving said coded digital signals and for converting said coded digital signals to a plurality of latched output control signals for controlling video and nonvideo functions in said television receiver in response to the video information received from said microcomputer.

2. A system as in claim 1 further comprising means coupled to said address register means for providing an incrementing signal thereto for automatically incrementing said memory address code signals in storing the next sequence of said character code signals in the next adjacent addressable memory location in said first memory means.

3. A system as in claim 2 wherein said incrementing signal is provided to said address register means when said first edge of said timing pulse is received by said bus means.

4. A system as in claim 1 wherein said latched output signals are provided to various television receiver circuitry including video blanking circuitry and audio muting circuitry for controlling video blanking and audio muting and to telephone switching circuitry for converting said television receiver to a television/telephone system.

5. A system as in claim 1 further including character position control means comprising:

means for detecting a vertical sync pulse in said cathode ray tube;

means for counting horizontal sync pulses following a vertical sync pulse and for generating a first timing signal when a predetermined number of horizontal sync pulses have been counted;

timing means coupled to said horizontal sync pulse counting means for providing a plurality of pulses of predetermined duration in response to receipt of said first timing signal; and means coupled to said timing means for counting said pulses and to said control means for providing a display signal to said control means when a predetermined number of pulses have been counted for initiating the display of said characters at a desired position on the face of said cathode ray tube.

6. A system for converting a plurality of parallel output signals representing video information from a microcomputer into latched control signals and characters for presentation in a dot matrix form on the display face of a cathode ray tube in a television receiver having video and audio generating and blanking and muting circuitry and telephone switching circuitry, wherein ordered character display positions are scanned in successive lines on said display face with said microcomputer output signals including character code signals, memory address code signals and timing pulse signals, said system comprising:

bus means for receiving said plurality of microcomputer parallel output signals and for converting said signals into a series of coded digital signals;

first memory means coupled to said bus means for sequentially storing data representative of said control signals and said characters in a plurality of addressable memory locations, the spatial position of each of said memory locations corresponding to the positions of said characters as displayed on the face of said cathode ray tube;

address register means coupled to said bus means and responsive to said timing pulse signals for providing said memory address code signals to said first memory means when a first edge of said timing pulse signal is received by said bus means and for providing said character code signals to said first memory means for storage therein when a second edge of said timing pulse signal is received by said bus means;

second memory means adapted to store dot matrix images representing said characters in a plurality of addressable memory locations therein;

control means coupled to said second memory means and said first memory means for selecting and reading out particular ones of said dot matrix images from said second memory means according to the sequential storage of said characters in said first memory means and for providing said dot matrix images to said cathode ray tube;

character positioning means comprising:

means for detecting a vertical sync pulse in said cathode ray tube;

means for counting horizontal sync pulses following a vertical sync pulse and for generating a first timing signal when a predetermined number of horizontal sync pulses have been counted;

timing means coupled to said horizontal sync pulse counting means for providing a plurality of pulses of predetermined duration in response to receipt of said first timing signal; and means coupled to said timing means for counting said pulses and to said control means for providing a display signal to said control means when a predetermined number of pulses have been counted for initiating the display of said characters at a desired position on the face of said cathode ray tube; and latch means including a plurality of latches coupled to said bus means for receiving said coded digital signals and for converting said coded digital signals to a plurality of latched output control signals for controlling video and nonvideo functions in said television receiver in response to the video information received from said microcomputer and wherein said latch means is coupled to said telephone switching circuitry for converting said television receiver to a television/telephone system and to said video blanking and audio muting circuitry for blanking and muting said television receiver simultaneously therewith in response to said latched output control signals.

* * * * *